US005682167A

United States Patent [19]

Mullen et al.

[11] Patent Number: 5,682,167

[45] Date of Patent: Oct. 28, 1997

[54] MESA ANTENNA

[75] Inventors: Frank E. Mullen, No. Easton; William L. Robbins, Newton Center, both of Mass.

[73] Assignee: The Charles Stark Draper Laboratory, Cambridge, Mass.

[21] Appl. No.: 783,071

[22] Filed: Jan. 15, 1997

Related U.S. Application Data

[63] Continuation of Ser. No. 408,493, Mar. 22, 1995, abandoned.

[51] Int. Cl.[6] ..... H01Q 11/38

[52] U.S. Cl. ..... 343/700 MS; 343/830

[58] Field of Search ..... 343/700 MS, 846, 343/702, 828, 829, 830, 848; H01Q 1/38

[56] References Cited

U.S. PATENT DOCUMENTS

| | | | |
|---|---|---|---|
| H1460 | 7/1995 | Davis | 343/700 MS |
| 3,990,078 | 11/1976 | Bellee et al. | 343/770 |
| 4,089,003 | 5/1978 | Conroy | 343/700 MS |
| 4,263,598 | 4/1981 | Bellee et al. | 343/700 MS |
| 4,800,392 | 1/1989 | Garay et al. | 343/700 MS |
| 5,319,378 | 6/1994 | Nalbandian et al. | 343/700 MS |

FOREIGN PATENT DOCUMENTS

| | | | |
|---|---|---|---|
| 1-286501 | 11/1989 | Japan | H01Q 1/32 |

OTHER PUBLICATIONS

Guha, J.P., *Synthesis and Characterization of Barium Lanthanum Titanates,* J. Am. Ceram. Soc. 74[4]878–80 (1991).

Wu, Jenn–Ming and Chang, Ming–Chu, Reaction Sequences and Effects of Calcination on Microwave Properties of [Ba,Sr], O–$Sm_2O_3$–$TiO_2$ Ceramics, J. Am. Ceram. Soc. 73[6] 1599–605 (1990).

Takahashi, Junichi and Ikegami, Takashi, Occurrence of Dielectric 1:1:4 Compound in the Ternary System BaO–$Ln_2$–$O_3$–$Tio_2$[Ln=La,Nd, and Sm]: II, Reexamination of Formation of Isostructural Ternary Compounds in Identical Systems, J. Am. Ceram. So., 74[8] 1873–79 (1991).

Dielectric Resonators, A Designer's Guide to Microwave Dielectric Ceramics, Trans–Tech, Inc., "The Ceramic Solution".

*Primary Examiner*—Hoanganh T. Le
*Attorney, Agent, or Firm*—Lappin & Kusmer LLP

[57] ABSTRACT

The present invention provides an antenna including a relatively thin substantially planar electrically conductive first layer substantially lying in a first plane, and a relatively thin substantially planar electrically conductive second layer substantially lying in a second plane. The first and second layers are disposed such that the first and second planes are substantially parallel and such that they are separated by a distance d. The second layer is smaller than and overlies the first layer and defines a first region extending between the second layer and a portion of the first layer underlying the second layer. The antenna further includes a first dielectric medium having a relatively high dielectric constant and disposed in the first region, and a second dielectric medium having a relatively low dielectric constant and disposed in a second region extending between the first layer and portions of the second plane overlying the first layer and excluding the first region.

15 Claims, 2 Drawing Sheets

MESA ANTENNA

This application is a continuation of application Ser. No. 08/408,493, filed Mar. 22, 1995, now abandoned.

BACKGROUND OF THE INVENTION

The present invention relates to the design and construction of microstrip antennas. More particularly, the invention relates to microstrip antennas including a substrate that has a high dielectric constant.

Microstrip, patch, and stripline antennas (hereinafter referred to collectively as "microstrip" antennas) are designed for RF transmission and reception. Such antennas are typically composed of a dielectric substrate sandwiched between a ground plane and a metal radiating patch. A metal probe connects the radiating patch to a signal carrier (normally a coaxial cable) which is normally disposed on a side of the ground plane opposite the radiating patch. The metal probe therefore passes through void areas in the ground plane and the substrate. Such antennas act as transmitters with the radiating patch radiating an electromagnetic signal in response to RF energy delivered to the patch via the signal carrier and the metal probe. Such antennas also act as receivers with the radiating patch receiving signals and transferring them to the signal carrier.

As is well known, the length of the radiating patch of a microstrip antenna, is inversely proportional to the square root of the dielectric constant of the substrate. For example, half wavelength microstrip antennas behave according to the following equation:

$$l_{patch}=\frac{\lambda}{2}\approx\frac{c}{2f\sqrt{\kappa}} \quad (1)$$

where $l_{patch}$ is the length of the radiating patch, $f$ is the operating frequency of the antenna, $\lambda$ is the operating wavelength, c is the speed of light in a vacuum, and K is the dielectric constant of the substrate. The dielectric constant for free space is 1. Most microstrip antennas are fabricated with a substrate having a dielectric constant of less than 10. A value of greater than 10 is considered a high dielectric constant.

One way to reduce the size of an antenna while holding the operating frequency constant is to increase the dielectric constant of the substrate. However, prior antennas constructed with high dielectric constants have suffered from serious drawbacks.

While the length of the radiating patch varies inversely with the dielectric constant, a substrate stores energy in the form of surface waves in a manner increasing with increases in the dielectric constant. Surface waves represent energy that becomes temporarily trapped in the substrate. Surface waves cause several undesirable effects such as reducing antenna gain and bandwidth, and distorting the radiation pattern emitted by the antenna.

Microstrip antennas are normally constructed with substrates having a low dielectric constant (i.e., k<10) to reduce the problems associated with surface waves. However, such low range dielectric constants place limitations on the miniaturization that might be attained. Prior art attempts to overcome such limitations by using higher dielectric constant substrates use structural modifications to the substrate such as roughing the substrate surface and/or etching trenches in and drilling holes in the substrate. These modifications tend to alter the boundary conditions which support surface wave propagation, and reduce the effect of such waves. However, these methods are highly empirical. There is no known analytical method for determining where to optimally place the non-uniformities. Further, there is no way to predict whether a given set of non-uniformities will be effective for a particular antenna.

There is therefore a need for an improved high dielectric constant microstrip antenna which reduces the effects associated with surface waves.

It is therefore an object of the invention to provide a microstrip antenna including a substrate having a dielectric constant of greater than 10.

It is also an object of the invention to provide a microstrip antenna including a substrate having a dielectric constant of approximately 80.

It is a further object of the invention to provide a high frequency antenna of reduced size.

Other objects and advantages of the present invention will become apparent upon consideration of the appended drawings and description thereof.

SUMMARY OF THE INVENTION

These and other objects of the invention are achieved by the present invention which, in one aspect, provides an antenna including a relatively thin substantially planar electrically conductive first layer substantially lying in a first plane. The antenna further includes a relatively thin substantially planar electrically conductive second layer substantially lying in a second plane disposed such that the first and second planes are substantially parallel and such that they are separated by a distance d. The second layer is smaller than and overlies the first layer and defines a first region extending between the second layer and a portion of the first layer underlying the second layer. The antenna further includes a first dielectric medium having a relatively high dielectric constant and disposed in the first region, and a second dielectric medium having a relatively low dielectric constant and disposed in a second region extending between the first layer and portions of the second plane overlying the first layer and excluding the first region.

The first region may include a region having a uniform cross section that is substantially equal to and substantially underlies the second layer. The second region may include a region that substantially overlies the first layer.

The first dielectric medium may include a ceramic material and may include Barium Lanthanum and Titanate. The first dielectric medium may be characterized by a dielectric constant that is greater than 30 and which may be substantially equal to 80. The second dielectric medium may be a vacuum or may include air.

The antenna may include a coupling device for coupling the second layer to a signal carrying cable. The coupling device may be an elongated electrically conductive probe element that passes through a void region in the first layer, and the signal carrying cable may be a coaxial cable having a center conductor electrically coupled to the probe element and an outer shield electrically connected to the first layer.

The antenna may be characterized by being principally responsive to a particular wavelength. The second layer may be elongated and have a length L in its long direction. The length L may be substantially equal to one half of the particular wavelength or may be substantially equal to one quarter of the particular wavelength. The distance d may be substantially equal to one third of the particular wavelength.

The first layer may have a rectangular shape, and the second layer may have a rectangular shape.

BRIEF DESCRIPTION OF THE DRAWINGS

For a fuller understanding of the nature and the objects of the invention, reference should be made to the following detailed description and the accompanying drawings in which like reference numerals refer to like elements and in which.

DETAILED DESCRIPTION OF THE PREFERRED EMBODIMENT

Figure 1:
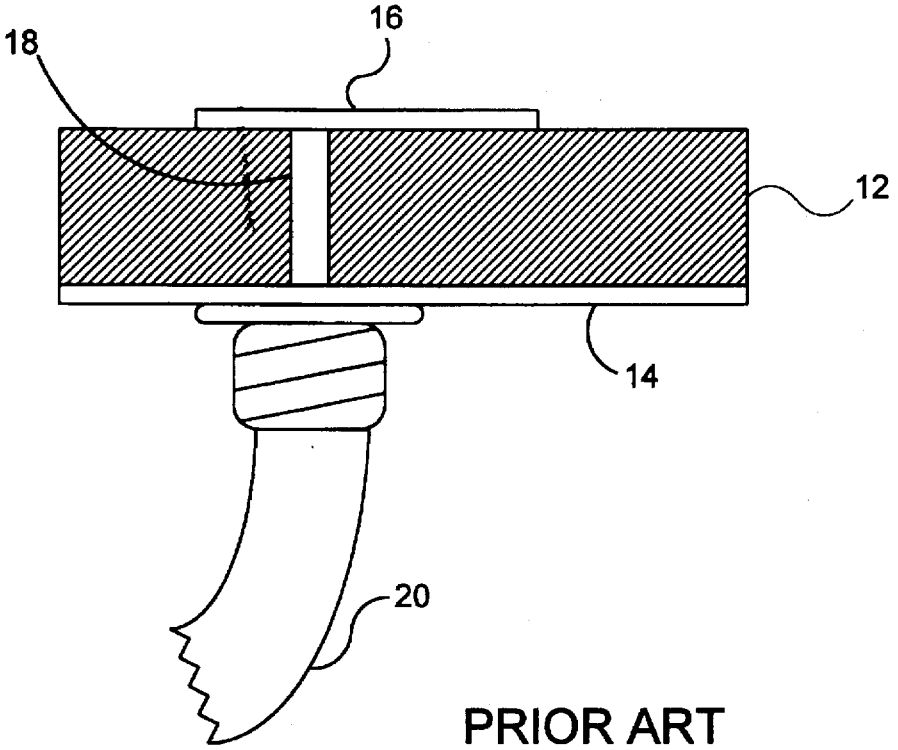
PRIOR ART FIG. 1
FIG. 1 is a cross sectional side view of a prior art microstrip antenna.

FIG. 1 shows a sectional side view of a prior art microstrip antenna 10, including a substrate 12 sandwiched between a ground plane 14 and a radiating patch 16. Metal probe 18 couples radiating patch 16 to a coaxial cable 20 through substrate 12 and ground plane 14. Such prior art antennas are well known and typically only function properly if substrate 12 has a dielectric constant of less than ten. If the dielectric constant of substrate 12 is relatively high, such as greater than ten, the undesirable effects associated with surface waves interfere unacceptably with the performance of the antenna.

Figure 2A:
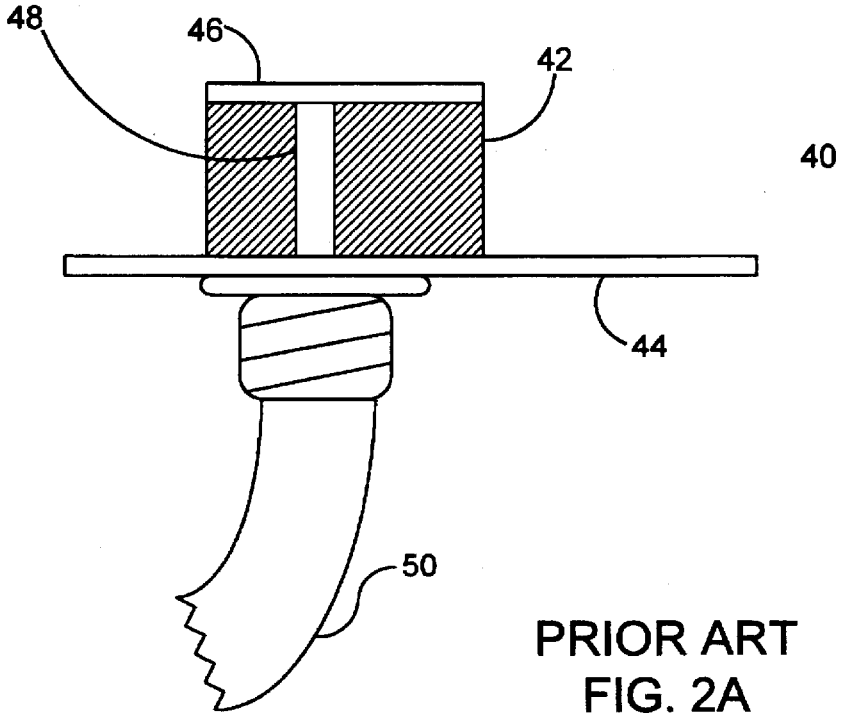
PRIOR ART FIG. 2A
FIG. 2A is a cross sectional side view of an antenna constructed according to the invention.
Figure 2B:
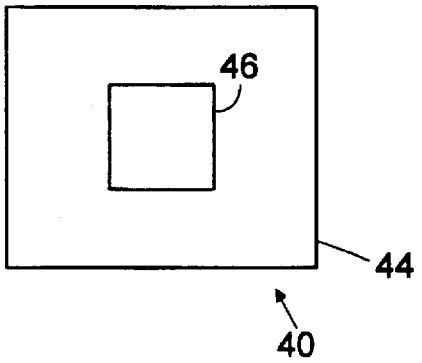
FIG. 2B is a top view of the antenna shown in FIG. 2A.

FIGS. 2A and 2B are sectional side, and top views, respectively, of a preferred embodiment of an antenna 40 constructed according to the invention. In antenna 40, substrate 42 is sandwiched between ground plane 44 and radiating patch 46. Metal probe 48 couples radiating patch 46 to a coaxial cable 50 through void regions in substrate 42 and ground plane 44. In antenna 40, substrate 42 is reduced in size such that radiating patch 46 substantially overlies substrate 42. The configuration of antenna 40 greatly reduces the problems associated with surface waves while retaining the miniaturization benefits associated with high dielectric constant substrates. Substrate 42 can therefore have a very high dielectric constant and not introduce undesirable effects due to surface waves into antenna 40. In one preferred embodiment, substrate 42 has a dielectric constant of 80. In another preferred embodiment, substrate 42 has a dielectric constant of 30.

Figure 3A:
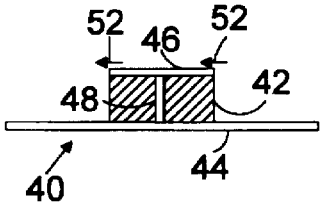
FIGS. 3A and 3B are cross sectional side views of an antenna constructed according to the invention illustrating the direction of the electric field in the region near the edges of the radiating patch at times corresponding to extreme points of the oscillating carrier signal.
Figure 3B:
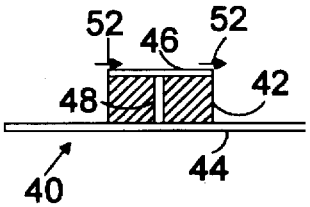

In operation, antenna 40 is driven by a modulated carrier signal which is transmitted to radiating patch 46 via probe 48. In FIG. 3A arrows 52 show the direction of the electric field near the edges of radiating patch 46 at a time $T_1$ corresponding to an extreme point in the oscillation of the carrier signal. In FIG. 3B arrows 52 show the direction of the electric field near the edges of radiating patch 46 at a time $T_2$ corresponding to the opposite extreme point in the oscillation of the carrier signal. As FIGS. 3A and 3B show, when radiating patch 46 is driven by a carrier signal, radiating patch 46 acts as a dipole, and the electric field near the edges of radiating patch 46 flips back and forth over time. Radiating patch 46 thus radiates an electromagnetic signal at a wavelength $\lambda$.

Figure 4A:
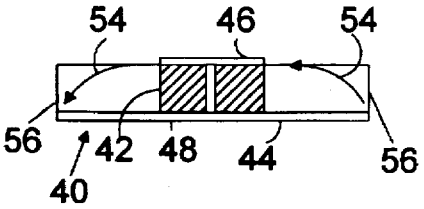
FIGS. 4A and 4B are cross sectional side views of an antenna constructed according to the invention illustrating the direction of the electric field in the region between the radiating patch and the ground plane at times corresponding to extreme points of the oscillating carrier signal.
Figure 4B:
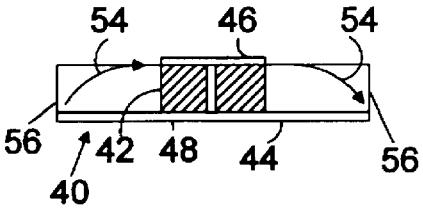

In FIGS. 4A and 4B the direction of the electric field, at times $T_1$ and $T_2$, respectively, between radiating patch 46 and ground plane 44, is illustrated by arrows 54. As shown in FIGS. 4A and 4B, the electric field between radiating patch 46 and ground plane 44 is concentrated in a region 56 where substrate 42 is not present. If substrate 42 were present in region 56, as in prior art antennas, the electric field would introduce substantial energy into substrate 42 and would produce surface waves. Since substrate 42 is not present in region 56, surface waves are not generated in substrate 42.

Antenna 40 may be considered as having two different substrates. A first substrate 42 which has a high dielectric constant, and a second substrate in region 56 which has a low dielectric constant, i.e., the dielectric constant of air or free space. In another embodiment, region 56 could be filled with a solid dielectric material having a dielectric constant substantially lower than that of substrate 42.

Preferably, substrate 42 is fabricated from a ceramic material. Ceramics are preferred because of their durability and because, as is well known in the art, the dielectric constant of a ceramic can be controlled by the fabrication process.

In addition to reducing surface waves, antenna 40 also provides an antenna of reduced weight, since the substrate 42 has a cross section only as large as radiating patch 46 rather than a cross section as large as ground plane 44. This weight reduction is particularly significant because in ceramic antennas, the substrate is the heaviest component.

Antenna 40 also offers increased manufacturing yield since smaller ceramics can be produced more reliably and less expensively than larger ceramics. Smaller ceramics are also less likely to crack during the antenna fabrication process. Further, since the material properties of smaller ceramics are more homogenous than larger ceramics, mass produced versions of antenna 40 perform within a small tolerance of design specifications.

The directivity of antenna 40, which is directly related to antenna gain, can be controlled by adjusting the size of ground plane 44. Increases in the size of ground plane 44 produce a more hemispherical radiation pattern. Due to the improved design of antenna 40, the gain can be adjusted by increasing the size of the ground plane without correspondingly increasing the size of substrate 42. Therefore, the gain of antenna 40 can be adjusted without a corresponding increase in weight due to increased substrate size.

Antenna 40 can be designed to perform at frequencies previously unavailable to microstrip antennas. In one embodiment, antenna 40 can be constructed to radiate at 300 MHz. In one such antenna, radiating patch 46 is 2.2 inches square, and substrate 42 has a corresponding cross section of 2.2 inches square. A conventional antenna operating at this frequency is substantially larger having a radiating patch that is typically on the order of 6.2 inches square. In another embodiment, antenna 40 can be constructed to radiate at 1.5 GHz. In such an antenna, radiating patch 46 is 0.44 inches square and substrate 42 has a correspondingly sized cross section.

Radiating patch 46 and ground plane 44 are separated by a distance (i.e., the height of substrate 42) which varies with the wavelength and dielectric constant. Preferably, where the dielectric constant is 80, and the frequency is about 1 GHz the distance is approximately one third of the wavelength.

Half wavelength and quarter wavelength antennas may be constructed according to the invention in which the length of the radiating patch is one half and one quarter, respectively, the length of the operating wavelength of the antenna.

The design of antenna 40 allows construction of hand-held, portable, radio sets, GPS (Global Positioning System)

receivers, flight data telemetry systems, covert communications systems, and infantry field radios.

The invention has been discussed in connection with antenna 40 in which the substrate 42 has a substantially uniform cross section which is substantially equal to the cross section of the radiating patch 46. As those skilled in the art will appreciate, antennas may be constructed according to the invention in which the cross section of the substrate is not uniform and may not be substantially equal to the cross section of the radiating patch. For example, the substrate may have a trapezoidal cross section which flares out at an end adjacent to the ground plane such that the substrate is wider near the ground plane than it is near the radiating patch. As those skilled in the art will appreciate, many other configurations of substrates and radiating patches are within the scope of the invention.

Also, while the invention is described in "planar" terminology, it will be understood that that terminology encompasses light variants from strict planar, such as rippled or slightly curved geometry.

Therefore, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

Having described the invention, what is claimed as new and secured by Letters Patent is:

1. An antenna comprising:

A. a relatively thin, substantially planar, electrically conductive first layer lying substantially in a first plane, B. a relatively thin substantially planar, electrically conductive second layer lying substantially in a second plane, disposed such that said second plane is substantially parallel to said first plane and such that said first and second planes are spaced apart by a distance d, wherein said second layer is smaller than and overlies said first layer and defines a first region extending between said second layer, and a portion of said first layer underlying said second layer, C. a first dielectric medium having a relatively high dielectric constant, said dielectric constant being greater than 30, and said first dielectric medium being disposed substantially only in said first region, and D. a second dielectric medium having a relatively low dielectric constant and disposed in a second region extending between said first layer and portions of said second plane overlying said first layer and excluding said first region.

2. An antenna according to claim 1 wherein said first region includes a region having a uniform cross section wherein said cross section is substantially equal to and substantially underlies said second layer.

3. An antenna according to claim 1 wherein said second region includes a region that substantially overlies said first layer.

4. An antenna according to claim 1 wherein said first dielectric medium comprises a ceramic material.

5. An antenna according to claim 1 wherein said first dielectric medium comprises Barium Lanthanum Titanate.

6. An antenna according to claim 1 wherein said first dielectric medium has a dielectric constant substantially equal to 80.

7. An antenna according to claim 1 wherein said second dielectric medium comprises air.

8. An antenna according to claim 1 wherein said second dielectric medium comprises a vacuum.

9. An antenna according to claim 1 further comprising coupling means for coupling said second layer to a signal carrying cable.

10. An antenna according to claim 9 wherein said coupling means is an elongated electrically conductive probe element and wherein said signal carrying cable is a coaxial cable having a center conductor electrically connected to said probe element and an outer shield electrically connected to said first layer wherein said probe element passes through a void region in said first layer.

11. An antenna according to claim 1 wherein said antenna is responsive to a signal having a wavelength in a range of $\lambda$ and wherein said distance d is substantially equal to $\lambda/3$.

12. An antenna according to claim 1 wherein said second layer is elongated and has a length L in its long direction, and wherein said antenna is principally responsive to a signal having a wavelength $\lambda$ and wherein L is substantially equal to $\lambda/2$.

13. An antenna according to claim 1 wherein said second layer is elongated and has a length L in its long direction, and wherein said antenna is responsive to a signal having a wavelength $\lambda$ and wherein L is substantially equal to $\lambda/4$.

14. An antenna according to claim 1 wherein said first layer has a rectangular shape.

15. An antenna according to claim 1 wherein said second layer has a rectangular shape.

* * * * *